US007747188B2

(12) United States Patent
Ishida

(10) Patent No.: US 7,747,188 B2
(45) Date of Patent: Jun. 29, 2010

(54) IMAGE FORMING APPARATUS AND SECONDARY TRANSFER ROLLER CLEANING METHOD OF THE IMAGE FORMING APPARATUS

(75) Inventor: Kazufumi Ishida, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 111 days.

(21) Appl. No.: 12/204,206

(22) Filed: Sep. 4, 2008

(65) Prior Publication Data

US 2009/0074488 A1 Mar. 19, 2009

Related U.S. Application Data

(60) Provisional application No. 60/972,461, filed on Sep. 14, 2007.

(51) Int. Cl.
*G03G 15/16* (2006.01)

(52) U.S. Cl. ..... 399/101

(58) Field of Classification Search ..... 399/98, 399/99, 101, 302, 313
See application file for complete search history.

(56) References Cited

U.S. PATENT DOCUMENTS 5,298,953 A * 3/1994 Lindblad et al. ..... 399/101
5,568,243 A * 10/1996 Durfee et al. ..... 399/98
7,317,884 B2 * 1/2008 Terae et al. ..... 399/101

FOREIGN PATENT DOCUMENTS

JP 11-035185 2/1999
JP 2004-094055 3/2004

* cited by examiner

*Primary Examiner*—Hoang Ngo
(74) *Attorney, Agent, or Firm*—Turocy & Watson, LLP

(57) ABSTRACT

A secondary transfer roller rotates in a first rotation direction during printing, and rotates in a second rotation direction opposite to the first rotation direction during a stop of the printing only within a specified range. When an image forming apparatus includes a lubricant supply unit, the secondary transfer roller rotates in the second rotation direction within the range where an amount of movement of a contact surface between the secondary transfer roller and the cleaning member is 3 mm or more and not larger than a distance on the contact surface from a contact part between the secondary transfer roller and the lubricant supply unit to a contact part between the secondary transfer roller and the cleaning member in the second rotation direction.

20 Claims, 3 Drawing Sheets

IMAGE FORMING APPARATUS AND SECONDARY TRANSFER ROLLER CLEANING METHOD OF THE IMAGE FORMING APPARATUS

CROSS-REFERENCE TO RELATED APPLICATION

This application is based upon and claims the benefit of priority from the prior U.S. Patent Application No. 60/972,461, filed on Sep. 14, 2007, the entire contents of which are incorporated herein by reference.

TECHNICAL FIELD

The present invention relates to an image forming apparatus such as a copier or a printer, and particularly to an image forming apparatus and a secondary transfer roller cleaning method of the image forming apparatus in which cleaning performance of a secondary transfer roller provided to be in contact with a driven roller of an image forming unit is improved.

BACKGROUND

An image forming apparatus includes a secondary transfer roller for transferring an image by bringing an image carrier, such as a transfer belt, into press contact with a record medium.

When the record medium is conveyed at a specified timing, toner does not adhere to the secondary transfer roller. However, for example, when a jam of the record medium occurs, and the record medium is not conveyed at the specified timing, the toner carried by the image carrier adheres. In this case, when a next sheet is conveyed, the toner adheres to the back side thereof, and a stain occurs.

In order to prevent this stain, an image forming apparatus including a cleaning member on a secondary transfer roller is proposed (for example, JP-A-2004-94055).

However, there is a problem that according to the arrangement of the cleaning member, contamination such as paper powder is accumulated on a secondary transfer roller contact part of the cleaning member, and defective cleaning occurs.

SUMMARY

It is an object of the present invention to provide an image forming apparatus in which cleaning performance of a secondary transfer roller is improved and a secondary transfer roller cleaning method of the image forming apparatus.

In an aspect of the present invention, an image forming apparatus includes a record medium supply mechanism to supply a record medium one by one, a conveyer mechanism to convey the record medium supplied from the record medium supply mechanism to a record medium discharge unit, an image forming unit that is disposed upstream of the record medium discharge unit of the conveyer mechanism and executes an image formation process to print an image based on image data onto the record medium conveyed by the conveyer mechanism, a secondary transfer roller that is provided to be in contact with a driven roller of the image forming unit, rotates in a first rotation direction during printing, and rotates in a second rotation direction opposite to the first rotation direction during a stop of the printing only within a specified range, a lubricant supply unit configured to supply a lubricant to a surface of the secondary transfer roller, and a plate-like cleaning member in contact with the surface of the secondary transfer roller.

DETAILED DESCRIPTION

Throughout this description, the embodiments and examples shown should be considered as exemplars, rather than limitations on the apparatus and methods of the present invention.

Hereinafter, an embodiment of an image forming apparatus in which the cleaning performance of a secondary transfer roller is improved according to the present invention (hereinafter referred to as an image forming apparatus) will be described in detail with reference to the drawings.

(Outline of the Image Forming Apparatus)

Figure 4:
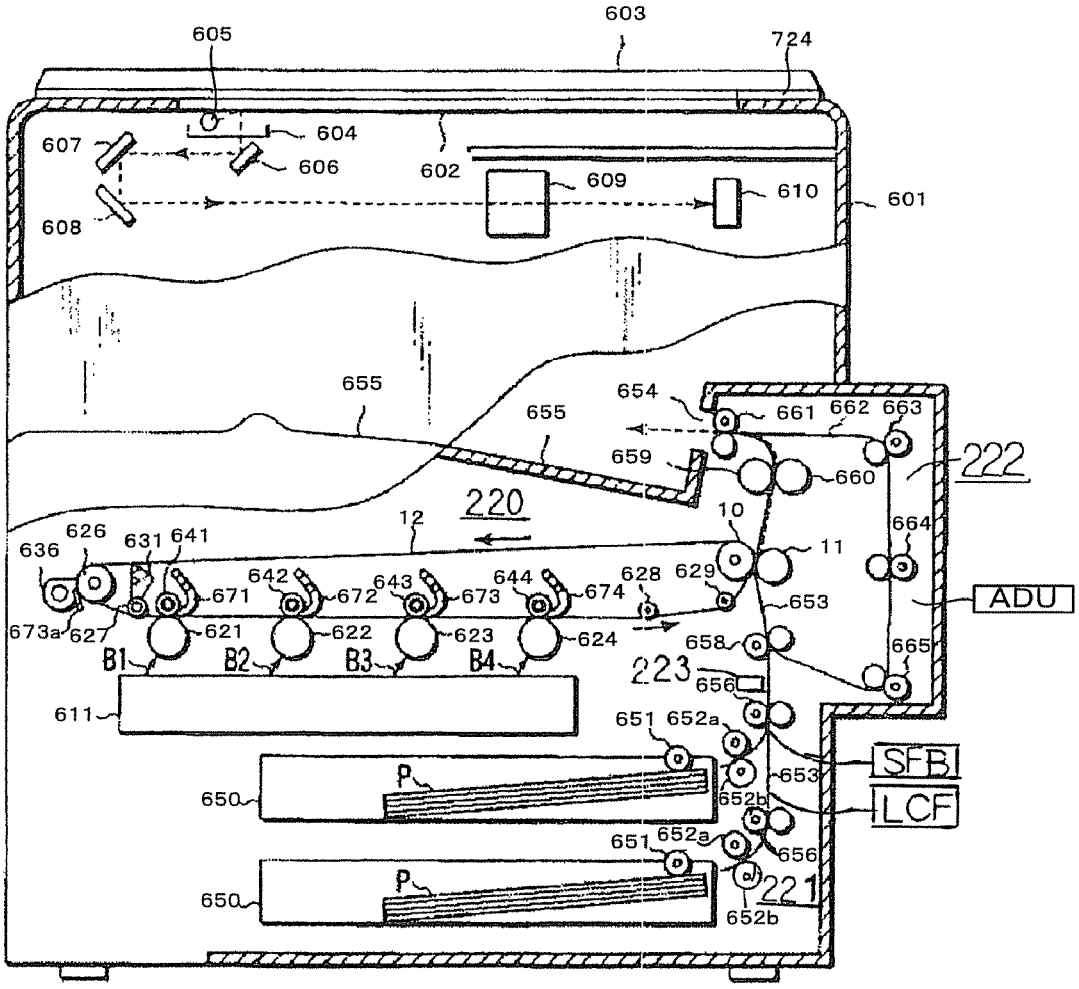
FIG. 4 is a view showing a structural example of an image forming apparatus.

FIG. 4 is a view showing a structural example of the image forming apparatus. As shown in FIG. 4, a document stand 602 for mounting documents, which is formed of a transparent material such as, for example, a glass plate, is provided at an upper part of an apparatus main body 601. A cover 603 is openably and closably mounted on the apparatus main body 601 so as to cover the document stand 602.

A scan unit (not shown) to optically read an image of an original document mounted on the document stand 602 is provided at the lower side of the document stand 602 in the inside of the apparatus main body 601. For example, the scan unit includes a carriage 604, reflecting mirrors 606, 607 and 608 to reflect a light of an exposure lamp 605 reflected by the original document, a scaling lens block 609 to scale the reflected light, and a CCD (Charge Coupled Device) 610. The carriage 604 is provided with the exposure lamp 605 to irradiate the light to the document stand 602, and is constructed to be capable of reciprocating along the lower surface of the document stand 602.

The carriage 604 moves while the exposure lamp 605 is being turned on, so that the original document mounted on the document stand 602 is exposed. A reflected light image of the original document, which is mounted on the document stand 602, by the exposure is projected onto the CCD 610 through the reflecting mirrors 606, 607 and 608 and the scaling lens block 609. The CCD 610 outputs image data corresponding to the projected reflected light image of the original document.

An image forming unit 220 is provided below the scan unit in the inside of the apparatus main body 601. The image forming unit 220 includes, for example, a print engine (not shown) and a process unit (not shown).

The print engine includes an exposure unit 611. The process unit includes photoconductive drums 621, 622, 623 and 624 arranged along the exposure unit 611, an endless transfer belt 12 arranged to be opposite to the exposure unit 611 across the photoconductive drums 621, 622, 623 and 624, a drive roller 626 to drive the transfer belt 12, primary transfer rollers 641, 642, 643 and 644 arranged to be opposite to the photoconductive drums 621, 622, 623 and 624 across the transfer belt 12, and a transfer roller drive unit to drive the primary transfer rollers 641, 642, 643 and 644.

The transfer belt 12 is stretched over the drive roller 626, guide rollers 627, 628 and 629 and a driven roller 10, receives power from the drive roller 626, and rotates and runs in the counterclockwise direction. The guide roller 627 is provided to be freely moved up and down, and receives the rotation of a cam 631 to be moved to the transfer belt 12 side. By this, the guide roller 627 displaces the transfer belt 12 to the side of the photoconductive drums 621, 622, 623 and 624.

The image forming unit 220 executes an image formation process to form an image based on image data (image signal outputted from the CCD 610) and to print the image onto the record medium being conveyed. That is, after the image signal outputted from the CCD 610 is suitably processed, it is supplied to the exposure unit 611. The exposure unit 611 emits a laser beam B1 corresponding to a yellow color image signal to the photoconductive drum 621 for yellow, emits a laser beam B2 corresponding to a magenta color image signal to the photoconductive drum 622 for magenta, emits a laser beam B3 corresponding to a cyan color image signal to the photoconductive drum 623 for cyan, and emits a laser beam B4 corresponding to a black color image signal to the photoconductive drum 624 for black.

The primary transfer rollers 641, 642, 643 and 644 are moved (lowered) to the transfer belt 12 side, so that the transfer belt 12 is brought into contact with the photoconductive drums 621, 622, 623 and 634, and visible images on the photoconductive drums 621, 622, 623 and 624 are transferred to the transfer belt 12.

A not-shown drum cleaner, a charge-removal lamp, a charging unit, and a developing unit are sequentially arranged around the photoconductive drum 621. The drum cleaner includes a drum cleaning blade which comes in contact with the surface of the photoconductive drum 621, and scrapes away a developer remaining on the surface of the photoconductive drum 621 by the drum cleaning blade.

The charge-removal lamp removes a charge remaining on the surface of the photoconductive drum 621. The charging unit applies a high voltage to the photoconductive drum 621, so that the surface of the photoconductive drum 621 is charged with an electrostatic charge. The laser beam B1 emitted from the exposure unit 611 is irradiated to the surface of the charged photoconductive drum 621. An electrostatic latent image is formed on the surface of the photoconductive drum 621 by this irradiation. The developing unit supplies an yellow developer (toner) to the surface of the photoconductive drum 621, so that the electrostatic latent image on the surface of the photoconductive drum 621 is made a visible image.

Also in the other photoconductive drums 622, 623 and 624, similarly, developers of the corresponding colors are used and electrostatic latent images on the surfaces of the respective photoconductive drums 622, 623 and 624 are made visible images.

A cleaner 636 is provided at a position opposite to the drive roller 626 of the image forming unit 220 across the transfer belt 12. This cleaner 636 includes a cleaning blade 636*a* which comes in contact with the transfer belt 12, and scrapes away a developer remaining on the transfer belt 12 by the cleaning blade 636*a*.

The printing mode is changed as described below. Hooks 671, 672, 673 and 674 are provided in the vicinities of the primary transfer rollers 641, 642, 643 and 644. The hooks 671, 672, 673 and 674 are engaged with shafts of the primary transfer rollers 641, 642, 643 and 644 to raise the shafts while rotating, and move the primary transfer rollers 641, 642, 643 and 644 in the direction of separating from the photoconductive drums 621, 622, 623 and 624. The printing mode, such as a full-color mode, all separation mode or a monochrome mode, is changed by not moving any of the primary transfer rollers 641, 642, 643 and 644 or by changing the combination of the rollers to be moved.

Next, a containing mechanism and a supply mechanism of record media will be described. Plural record medium cassettes 650 to contain record media are provided below the exposure unit 611. In these record medium cassettes 650, a number of record media P different from one another in record medium type are contained in a stacked state. A record medium supply mechanism 221 to supply the record medium in the record medium cassette 650 one by one from above is provided at an exit portion (right in the drawing) of each of the record medium cassettes 650. By this record medium supply mechanism 221, the record medium P is taken out one by one from any one of the record medium cassettes 650. The record medium supply mechanism 221 for taking out includes a pickup roller 651, a record medium supply roller 652*a*, and a separating roller 652*b*, separates the record medium P, which is taken out from the record medium cassette 650, one by one, and supplies it to a conveyer mechanism 653.

Next, the conveyance path of the record medium will be described. The conveyer mechanism 653 extends to an upper record medium discharge port 654 through the driven roller 10 of the image forming unit 220. The record medium discharge port 654 faces a record medium discharge unit 655 continuous with the outer peripheral surface of the apparatus main body 601. At the starting end side of the conveyance path 653, a conveyance roller 656 is provided in the vicinity of each of the record medium supply mechanisms 221. When the record medium is supplied by one of the record medium supply mechanisms 221, the conveyer mechanism 653 conveys the supplied record medium to the record medium discharge unit 655.

A secondary transfer roller 11 is provided at a halfway position of the conveyer mechanism 653 where it is opposite to the driven roller 10 across the transfer belt 12. A register roller 658 is provided at an upstream position of the driven roller 10 and the secondary transfer roller 11 in the conveyance direction.

At the timing in synchronization with the transfer operation as an operation of transferring an image formed with a developer (toner) to the record medium by the transfer belt 12 and the secondary transfer roller 11, the register roller 658 sends the record medium P to between the transfer belt 12 and the secondary transfer roller 11. The secondary transfer roller 11 holds the record medium P sent from the register roller 658 between itself and the transfer belt 12 on the driven roller 10, transfers the visible image formed with the developer (toner) and transferred on the transfer belt 12 to this record medium P, and prints it. As stated above, the register roller 658 conveys the record medium P to the image forming unit 220 including the transfer belt 12 and the secondary transfer roller 11 in synchronization with the transfer operation of the image forming unit 220.

A heat roller 659 for heat fixation and a press roller 660 in contact with the heat roller 659 are provided at a downstream position of the conveyer mechanism 653 with respect to the secondary transfer roller 11. The image transferred on the record medium P is fixed by the heat roller 659 and the press roller 660. Incidentally, a record medium discharge roller 661 is provided at the terminal end of the conveyer mechanism 653.

An auto duplex unit (hereinafter referred to as ADU) 222 may be provided in the apparatus main body 601. The ADU 222 is installed so as to couple a sub-conveyance path 662, which is a path for conveying the record medium P in the ADU 222, to the terminal end of the conveyer mechanism 653 and to an inlet toward the register roller 658. The sub-conveyance path 662 branches away from the downstream side (terminal end of the conveyer mechanism 653) of the conveyer mechanism 653 with respect to the image forming unit 220, and meets the upstream side (upstream side position of the register roller 658) of the conveyer mechanism 653 with respect to the image forming unit 220.

The sub-conveyance path 662 reverses the obverse and reverse of the record medium P for two-sided printing. The sub-conveyance path 662 is provided with record medium supply rollers 663, 664 and 665, and the ADU 222 reversely sends the record medium P conveyed from the image forming unit 220 to the record medium discharge unit 655, conveys it along the sub-conveyance path 662, and causes it to meet the conveyer mechanism 653 at the upstream side of the image forming unit 220. When the conveyance is made in this way, the obverse and reverse of the record medium P is reversed.

After the record medium P returned to the upstream side of the image forming unit 220 through the sub-conveyance path 662 meets the conveyer mechanism 653, the register roller 658 establishes synchronization with the transfer operation of the image forming unit 220, and the record medium is sent to the transfer position where the transfer belt 12 is in contact with the secondary transfer roller 11. In this way, the visible image on the transfer belt 12 is transferred also to the reverse surface of the record medium P and is printed.

When the two-sided printing is specified through the operation panel 724 provided on the apparatus main body 601 or the computer connected to the apparatus main body 601 through the network, the sub-conveyance path 662 of the ADU 222 is brought into the state of performing the operation to reverse the obverse and reverse of the record medium P.

Next, an additionally provided device will be described. In the example of the apparatus main body 601 shown in FIG. 4, the two record medium cassettes 650 are provided as the supply source of the record medium. Three or more record medium cassettes 650 may be provided in the apparatus main body 601. In addition, although not shown, a manual feed record medium supply mechanism (hereinafter referred to as SFB), or a large capacity record medium feeder (hereinafter referred to as LCF), which is a record medium supply mechanism capable of containing several thousand record media in a stacked form, can also be provided. The SFB or the LCF is installed in the apparatus main body 601 so that the path to supply the record medium meets the conveyer mechanism 653.

A record medium kind sensor 223 may be provided in the apparatus main body 601. The record medium kind sensor 223 is arranged on the upstream side of the conveyer mechanism 653 with respect to the image forming unit 220 and at an upstream position with respect to the register roller 658, and detects the record medium kind of the record medium P conveyed through the conveyer mechanism 653. As the record medium kind sensor 223, for example, a well-known sensor to determine the kind of the record medium P by detecting the thickness of the record medium P or the light transmittance can be used.

In the case where the SFB or the LCF is installed, the record medium kind sensor 223 is arranged on the downstream side of the meeting point between the record medium supply path from the SFB and the LCF and the conveyer mechanism 653. When the arrangement is made as stated above, the one record medium kind sensor 223 can detect the kinds of the record media P conveyed on the conveyer mechanism 653 from all record medium supply sources.

(Cleaning of the Secondary Transfer Roller)

(Explanation of Structure)

Figure 1:
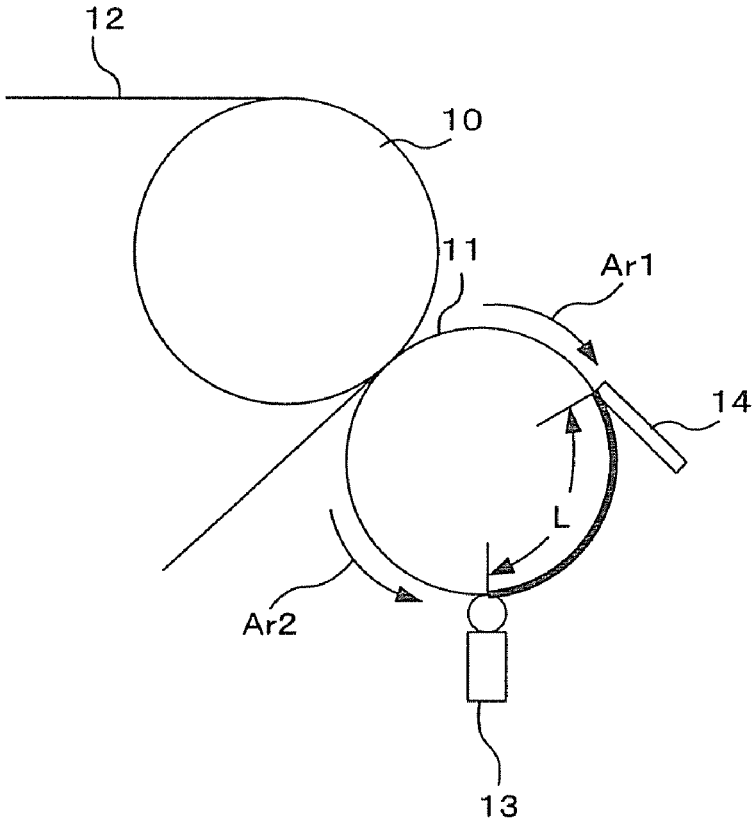
FIG. 1 is a side view schematically showing the vicinity of a secondary transfer roller.

FIG. 1 is a side view schematically showing the vicinity of the secondary transfer roller. As shown in FIG. 1, the image forming apparatus includes a lubricant supply unit 13 to supply a lubricant to the surface of the secondary transfer roller 11, and a plate-like cleaning member 14 in contact with the surface of the secondary transfer roller 11.

The lubricant supply unit 13 scrapes a specified amount of lubricant by a brush from a stick of lubricant such as a metal soap and supplies it to the secondary transfer roller 11. As the metal soap, zinc stearate is preferable in view of cost. The lubricant functions to limit the friction force generated between the secondary transfer roller 11 and the cleaning member 14 to a range of specified values. By this, the cleaning member 14 can scrape the developer adhered to the secondary transfer roller 11 without curling up or sliding.

The lubricant supply unit 13 is arranged such that a contact part between the cleaning member 14 and the secondary transfer roller 11, the lubricant supply unit 13, and a contact part between the driven roller 10 and the secondary transfer roller 11 are arranged in this order in a first rotation direction Ar1 of the secondary transfer roller 11.

Since the arrangement as stated above is adopted, there is an effect that the developer adheres on the lubricant, and the developer can be more easily scraped.

The secondary transfer roller 11 rotates in the first rotation direction indicated by the arrow Ar1 during printing, and rotates in a second rotation direction, which is indicated by an arrow Ar2 and is opposite to the first rotation direction, only within a specified range during a stop of the printing.

For example, when the first rotation direction is clockwise, the second rotation direction is counterclockwise.

That is, the secondary transfer roller 11 rotates in the second rotation direction Ar2 within the range where an amount of movement of a contact surface between the secondary transfer roller 11 and the cleaning member 14 is 3 mm or more and not larger than a distance L on the contact surface from the contact part between the secondary transfer roller 11 and the lubricant supply unit 13 to the contact part between the secondary transfer roller and the cleaning member 14 in the second rotation direction Ar2. In FIG. 1, the distance L is indicated by a thick line.

In order to remove contamination such as paper powder from the tip of the cleaning member 14, the movement distance of at least 3 mm is required. When the secondary transfer roller 11 rotates in the second rotation direction Ar2 by the distance L or more, the twice-applied lubricant reaches the cleaning member 14, and the lubricant is excessively supplied. In this case, the friction force is excessively lowered, the cleaning member 14 can not scrape the developer, and defective cleaning occurs.

Incidentally, since the friction force is ensured within a suitable range according to the material of the secondary transfer roller 11 and the cleaning member 14, the image forming apparatus can be made not to include the lubricant supply unit 13.

In this case, the secondary transfer roller 11 rotates in the second rotation direction Ar2 within the range where the movement amount of the contact surface between the secondary transfer roller 11 and the cleaning member 14 is 3 mm or more and one rotation or less. When the secondary transfer roller rotates in the second rotation direction Ar2 by one rotation or more, it takes an excessively long time, and the start of printing is delayed.

It is desirable that the hardness of the secondary transfer roller 11 is a JISA hardness of 28° or higher and a JISA hardness of 40° or less. When softer than this, a vibration occurs between the secondary transfer roller and the cleaning member 14, the cleaning member 14 can not scrape the developer sufficiently, and defective cleaning occurs. When harder than this, a nip is not formed between the secondary transfer roller and the driven roller 10, and defective transfer occurs.

It is desirable that the hardness of the cleaning member 14 is a JISA hardness of 65° or higher and a JISA hardness of 80° or less. When softer than this, the cleaning member 14 curls up. When harder than this, the driven roller 11 is damaged.

Figure 2:
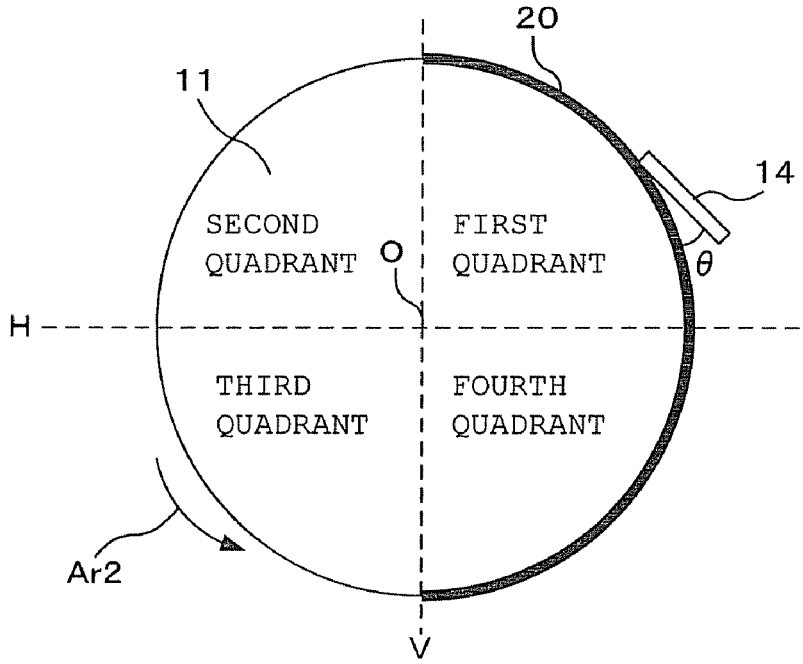
FIG. 2 is a view showing a positional relation between a secondary transfer roller 11 and a cleaning member 14.

FIG. 2 is a side view showing a positional relation between the secondary transfer roller 11 and the cleaning member 14. As shown in FIG. 2, when the first rotation direction Ar1 is clockwise, four quadrants of the first quadrant to the fourth quadrant are imagined which are divided by the vertical line V in the gravity direction passing through the rotation axis O of the secondary transfer roller 11 and the horizontal line H crossing vertically at the rotation axis O. At this time, the cleaning member 14 contacts with the secondary transfer roller 11 in a right portion 20 of the vertical line V, that is, in the first quadrant and the fourth quadrant.

Incidentally, when the first rotation direction Ar1 and the second rotation direction Ar2 are respectively reversed, the cleaning member 14 contacts with the secondary transfer roller 11 in a left portion of the vertical line V, that is, in the second quadrant and the third quadrant.

Besides, the cleaning member 14 contacts with the surface of the secondary transfer roller 11 on the near side in the second rotation direction Ar2 so as to form an acute angle θ.

When the cleaning member 14 is arranged relatively to the secondary transfer roller 11 as stated above, when the secondary transfer roller 11 rotates in the first rotation direction Ar1, contamination such as paper powder is liable to be accumulated in a contact point between the cleaning member 14 and the secondary transfer roller 11. That is, when the arrangement as stated above is adopted from the restriction of layout or the like, it becomes difficult to cause the contamination to drop from the cleaning member 14 by using the gravity.

In the image forming apparatus of the embodiment, even when the arrangement as stated above is adopted, the contamination accumulated on the cleaning member 14 can be removed by rotating the secondary transfer roller 11 in the second rotation direction Ar2.

(Explanation of Operation)

Figure 3:
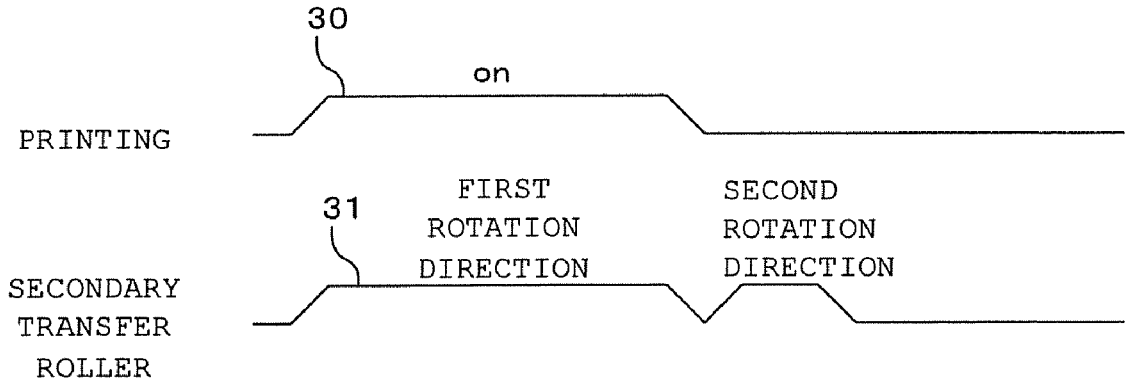
FIG. 3 is a timing chart of an operation of the secondary transfer roller 11.

FIG. 3 is a timing chart of an operation of the secondary transfer roller 11. A chart 30 represents printing, and a chart 31 represents the operation of the secondary transfer roller 11.

As shown in FIG. 3, the secondary transfer roller 11 rotates in the first rotation direction Ar1 during the printing. During a stop of the printing, the secondary transfer roller is separated from the transfer belt 12 and rotates in the second rotation direction Ar2 opposite to the first rotation direction Ar1 only within the specified range.

The developer is apt to be solidified by heat and pressure. Thus, it is desirable that immediately after the developer is scraped from the secondary transfer roller 11, the secondary transfer roller 11 is separated from the transfer belt 12, and rotates in the second rotation direction Ar2 to remove the accumulated developer and contamination.

For that purpose, it is desirable that the secondary transfer roller 11 rotates in the first rotation direction Ar1 during the printing, and rotates in the second rotation direction Ar2 after the printing.

As described above, in the image forming apparatus of the embodiment, the secondary transfer roller 11 rotates in the first rotation direction Ar1 during the printing, and rotates in the second rotation direction Ar2 opposite to the first rotation direction Ar1 only within the specified range during the stop of the printing. Thus, there is an effect that even in the layout in which contamination accumulated in the contact part between the cleaning member 14 and the secondary transfer roller 11 can not be removed by using the gravity, the contamination can be effectively removed.

Although exemplary embodiments of the present invention have been shown and described, it will be apparent to those having ordinary skill in the art that a number of changes, modifications, or alterations to the invention as described herein may be made, none of which depart from the spirit of the present invention. All such changes, modifications, and alterations should therefore be seen as within the scope of the present invention.

What is claimed is:

1. An image forming apparatus comprising:

a record medium supply mechanism to supply a record medium one by one;

a conveyer mechanism to convey the record medium supplied from the record medium supply mechanism to a record medium discharge unit;

an image forming unit that is disposed upstream of the record medium discharge unit of the conveyer mechanism and executes an image formation process to print an image based on image data onto the record medium conveyed by the conveyer mechanism;

a secondary transfer roller that is provided to be in contact with a driven roller of the image forming unit, rotates in a first rotation direction during printing, and rotates in a second rotation direction opposite to the first rotation direction during a stop of the printing only within a specified range;

a lubricant supply unit configured to supply a lubricant to a surface of the secondary transfer roller; and a plate-like cleaning member in contact with the surface of the secondary transfer roller.

2. The apparatus according to claim 1, wherein the lubricant supply unit is arranged in order of a contact part between the cleaning member and the secondary transfer roller, the lubricant supply unit, and a contact part between the driven roller and the secondary transfer roller in the first rotation direction of the secondary transfer roller.

3. The apparatus according to claim 1, wherein when the first rotation direction is clockwise, the cleaning member contacts with the secondary transfer roller at a right portion of a vertical line in a gravity direction passing through a rotation axis of the secondary transfer roller when viewed from a side.

4. The apparatus according to claim 1, wherein the secondary transfer roller rotates in the second rotation direction within a range where an amount of movement of a contact surface between the secondary transfer roller and the cleaning member is 3 mm or more and not larger than a distance on the contact surface from a contact part between the secondary transfer roller and the lubricant supply unit to a contact part between the secondary transfer roller and the cleaning member in the second rotation direction as a counterclockwise direction.

5. The apparatus according to claim 1, wherein the secondary transfer roller rotates in the first rotation direction during the printing, and rotates in the second rotation direction after the printing is ended.

6. The apparatus according to claim 1, wherein the secondary transfer roller has a JISA hardness of 28° or higher and a JISA hardness of 40° or less.

7. The apparatus according to claim 1, wherein the cleaning member has a JISA hardness of 65° or higher and a JISA hardness of 80° or less.

8. An image forming apparatus comprising:

a record medium supply mechanism to supply a record medium one by one;

a conveyer mechanism to convey the record medium supplied from the record medium supply mechanism to a record medium discharge unit;

an image forming unit that is disposed upstream of the record medium discharge unit of the conveyer mechanism and executes an image formation process to print an image based on image data onto the record medium conveyed by the conveyer mechanism;

a secondary transfer roller that is provided to be in contact with a driven roller of the image forming unit, rotates in a first rotation direction during printing, and rotates in a second rotation direction opposite to the first rotation direction during a stop of the printing; and a plate-like cleaning member that contacts with a surface of the secondary transfer roller, when the first rotation direction is clockwise, at a right portion of a vertical line in a gravity direction passing through a rotation axis of the secondary transfer roller when viewed from a side and forms an acute angle with respect to the surface of the secondary transfer roller on a near side in the second rotation direction.

9. The apparatus according to claim 8, wherein the secondary transfer roller rotates in the second rotation direction within a range where an amount of movement of a contact surface between the secondary transfer roller and the cleaning member is 3 mm or more and one rotation or less.

10. The apparatus according to claim 8, wherein the secondary transfer roller rotates in the first rotation direction during the printing, and rotates in the second rotation direction after the printing is ended.

11. The apparatus according to claim 8, wherein the secondary transfer roller has a JISA hardness of 28° or higher and a JISA hardness of 40° or less.

12. The apparatus according to claim 8, wherein the cleaning member has a JISA hardness of 65° or higher and a JISA hardness of 800 or less.

13. A cleaning method of a secondary transfer roller of an image forming apparatus which prints an image created based on image data, the secondary transfer roller cleaning method of the image forming apparatus comprising:

rotating the secondary transfer roller in a first rotation direction during printing;

supplying a lubricant to the secondary transfer roller by a lubricant supply unit that supplies the lubricant;

scraping a developer adhered to the secondary transfer roller by a plate-like cleaning member; and rotating the secondary transfer roller in a second rotation direction opposite to the first rotation direction during a stop of the printing only within a specified range.

14. The method according to claim 13, wherein the lubricant supply unit is arranged in order of a contact part between the cleaning member and the secondary transfer roller, the lubricant supply unit, and a contact part between a driven roller and the secondary transfer roller in the first rotation direction of the secondary transfer roller, and when the first rotation direction is clockwise, the cleaning member contacts with the secondary transfer roller at a right portion of a vertical line in a gravity direction passing through a rotation axis of the secondary transfer roller when viewed from a side, and the secondary transfer roller rotates in the second rotation direction within a range where an amount of movement of a contact surface between the secondary transfer roller and the cleaning member is 3 mm or more and not larger than a distance on the contact surface from a contact part between the secondary transfer roller and the lubricant supply unit to a contact part between the secondary transfer roller and the cleaning member in the second rotation direction as a counterclockwise direction.

15. The method according to claim 13, wherein the secondary transfer roller rotates in the first rotation direction during the printing, and rotates in the second rotation direction after the printing is ended.

16. The method according to claim 13, wherein the secondary transfer roller has a JISA hardness of 28° or higher and a JISA hardness of 40° or less.

17. The method according to claim 13, wherein the cleaning member has a JISA hardness of 65° or higher and a JISA hardness of 80° or less.

18. The method according to claim 13, wherein the lubricant supply unit is arranged in order of a contact part between the cleaning member and the secondary transfer roller, the lubricant supply unit, and a contact part between a driven roller and the secondary transfer roller in the first rotation direction of the secondary transfer roller, and when the first rotation direction is counterclockwise, the cleaning member contacts with the secondary transfer roller at a left portion of a vertical line in a gravity direction passing through a rotation axis of the secondary transfer roller when viewed from a side, and the secondary transfer roller rotates in the second rotation direction within a range where an amount of movement of a contact surface between the secondary transfer roller and the cleaning member is 3 mm or more and not larger than a distance on the contact surface from a contact part between the secondary transfer roller and the lubricant supply unit to a contact part between the secondary transfer roller and the cleaning member in the second rotation direction as a clockwise direction.

19. The method according to claim 13, wherein the lubricant is a metal soap.

20. The method according to claim 13, wherein the lubricant is zinc stearate.

* * * * *